US009903662B2

(12) United States Patent
Nakamura

(10) Patent No.: US 9,903,662 B2
(45) Date of Patent: Feb. 27, 2018

(54) HEADER PLATELESS HEAT EXCHANGER

(71) Applicant: T.RAD Co., Ltd., Shibuya-ku, Tokyo (JP)

(72) Inventor: Yoichi Nakamura, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 101 days.

(21) Appl. No.: 15/106,040

(22) PCT Filed: Dec. 19, 2014

(86) PCT No.: PCT/JP2014/084739
§ 371 (c)(1),
(2) Date: Jun. 21, 2016

(87) PCT Pub. No.: WO2015/093625
PCT Pub. Date: Jun. 25, 2015

(65) Prior Publication Data

US 2016/0320139 A1 Nov. 3, 2016

(30) Foreign Application Priority Data

Dec. 20, 2013 (JP) ..... 2013-264012

(51) Int. Cl.
*F28D 7/10* (2006.01)
*F28D 9/00* (2006.01)
(Continued)

(52) U.S. Cl.
CPC ..... *F28D 9/0037* (2013.01); *F28D 7/1684* (2013.01); *F28D 21/0003* (2013.01);
(Continued)

(58) Field of Classification Search
CPC .... F28D 9/0037; F28D 7/1684; F28D 1/0316; F28D 9/0031; F28F 9/0246; F28F 1/025;
(Continued)

(56) References Cited

U.S. PATENT DOCUMENTS 4,681,155 A * 7/1987 Kredo ..... F28F 3/025 138/163
6,513,585 B2 * 2/2003 Brost ..... B21D 53/085 165/173
(Continued)

FOREIGN PATENT DOCUMENTS

FR 390904 A * 10/1908 ..... F28F 1/045
JP 2008-275246 11/2008
(Continued)

*Primary Examiner* — Len Tran
*Assistant Examiner* — Jon T Schermerhorn
(74) *Attorney, Agent, or Firm* — Norris McLaughlin & Marcus, P.A.

(57) ABSTRACT

With respect to a header plateless heat exchanger having as a component a flat tube formed by joining a pair of grooved plates together, air-tightness and liquid-tightness are improved between the portion of the flat tube where the plates are joined together and a header tank. A flat tube is formed by folding tab parts extending from side walls of a first plate back outwards to lie over the outer surfaces of those side walls of the first plate, and placing seating portions of side walls of a second plate on the upper end surfaces of the tab parts, after which a header tank is fitted on each longitudinal end of the flat tube.

4 Claims, 7 Drawing Sheets

(51) Int. Cl.

| | |
|---|---|
| ***F28F 9/02*** | (2006.01) |
| ***F28D 7/16*** | (2006.01) |
| ***F28F 3/08*** | (2006.01) |
| ***F28F 1/02*** | (2006.01) |
| ***F28D 21/00*** | (2006.01) |
| *F28F 9/18* | (2006.01) |

(52) U.S. Cl.
CPC ..... *F28F 1/025* (2013.01); *F28F 3/086* (2013.01); *F28F 9/0221* (2013.01); *F28F 9/182* (2013.01); *F28F 2009/029* (2013.01); *F28F 2265/16* (2013.01); *F28F 2275/04* (2013.01); *F28F 2275/12* (2013.01)

(58) Field of Classification Search
CPC ..... F28F 3/086; F28F 9/0221; F28F 9/0219; F28F 9/182; F28F 9/001; F28F 2009/029; F28F 2265/16; F28F 2275/04; F28F 2275/12; F28F 1/006; F28F 1/045
See application file for complete search history.

(56) References Cited

U.S. PATENT DOCUMENTS 6,668,916 B2 * 12/2003 Zobel ..... F28F 9/0221 165/173
2002/0108742 A1 * 8/2002 Lamich ..... F28F 9/0221 165/175
2003/0093900 A1 * 5/2003 Huguet ..... F28D 9/0037 29/890.03
2006/0219394 A1 * 10/2006 Martin ..... F28D 9/0043 165/157
2009/0065184 A1 * 3/2009 Miyagawa ..... F28D 9/0037 165/164
2010/0319889 A1 * 12/2010 Ikeda ..... F02B 29/0462 165/157
2011/0247318 A1 * 10/2011 Kuroyanagi ..... F02M 25/0737 60/278
2016/0084583 A1 * 3/2016 Maucher ..... F02M 25/0737 123/568.12

FOREIGN PATENT DOCUMENTS

JP 2011-002133 1/2011
JP 2011-0432574 3/2011
JP 2011043257 A * 3/2011 ..... F28F 9/0221
JP 2011163642 A * 8/2011
JP 2011-232020 11/2011

* cited by examiner

HEADER PLATELESS HEAT EXCHANGER

BACKGROUND OF THE INVENTION

The present invention relates to a header plateless heat exchanger obtained by stacking flat tubes having both ends bulging, more specifically, relates to one in which flat tubes are each formed by joining a pair of grooved plates together, in which air-tightness and liquid-tightness of the joining portion are improved.

Header plateless heat exchangers are such that flat tubes 5 having both ends bulging in a thickness direction are stacked at the bulging portions to form a core (6), and no header plate is required, as illustrated in FIG. 13 (see also FIG. 1). In addition, a pair of header tanks (6) are disposed, at the both ends of the core (6) in the longitudinal direction, and a casing (7) is fitted over the outer periphery of the core (6).

The flat tubes 5, which serve as constituent elements of this core (6), have a joined body including a first plate (1) and a second plate (2), which is formed into a pair of groove shapes. The core (6) and the header tank (8) of such a heat exchanger need to be connected using brazing without any gap.

Related prior art includes Japanese Patent Laid-Open No. 2011-2133 and Japanese Patent Laid-Open No. 2011-232020.

SUMMARY OF THE INVENTION

However, defect has been more likely to occur at the joining portion of this flat tube 5. More specifically, as illustrated in FIG. 13, both end portions of a side wall 1*a* of the first plate 1 in the longitudinal direction bulge outwardly in the width direction and have a stepped portion 10 formed thereon; and lower end surfaces of side walls 2*a* of a second plate 2 sits on the stepped portion 10. The corner portion of the stepped portion 10 usually has a round shape, and thus, a gap B is generated at the joining portion between the stepped portion 10 and the second plate 2. In addition, a large gap A is generated between the corner portion of the flat tube 5 and the inner surface of the header tank 8. This leads to a loss of brazing at the gaps A and B at the time of brazing of each part, possibly deteriorating air-tightness or liquid-tightness.

Accordingly, the present invention provides such one that does not generate a gap between the flat tube 5 which includes a joined body of a pair of the first plate 1 and the second plate 2, and the header tank 8. In addition, the objective is to provide a header plateless heat exchanger in which the gap generated between the first plate 1 and the second plate 2 is filled without difficulty, and which is less likely to have the loss of brazing.

The present invention according to a first aspect thereof provides a header plateless heat exchanger, including a first plate (1) and a second plate (2) each bent and formed into a groove shape by press forming, the plates (1) and (2) respectively including side walls (1*a*) and (2*a*) each having a height on each longitudinal end of the plate to be formed higher than a height at a midpoint portion of the plate.

the first plate (1) and the second plate (2) being joined with each other at the side wails (1*a*) and (2*a*) to form a flat tube (5) having a bulging portion (4) in a height direction on each longitudinal, end of the flat tube (5), a plurality of the flat tubes (5) being stacked at the bulging portion (4) to form a core (6), and a casing (7) being fitted over an outer periphery of the core (6) and a header tank (8) being disposed at both ends of the core (6), wherein tab parts (9) located at the bulging portion (4) and disposed so as to extend from the side walls (1*a*) of the first plate (1) are folded back to lie over outer surfaces of the side walls (1*a*) of the first plate (1), and lower end surfaces of the side walls (2*a*) of the second plate (2) sit on upper end surfaces (9*a*) of the tab parts (9), and lower end surfaces (9*c*) of the tab parts (9) match an outer surface of a groove bottom (1*b*) of the first plate (1).

The present invention according to a second aspect thereof provides the header plateless heat exchanger according to the first aspect, wherein a lower end portion of the tab part (9) in a height direction is cut-out at a folding-back position to form a cut-out portion (11) at that position, thus facilitating folding back at the end portion.

The present invention according to a third aspect thereof provides the header plateless heat exchanger according to the first or second aspect, wherein a recessed portion (12) or a claw (13) is provided by striking in a thickness direction, located on a lower end edge of the tab part (9) to partially fill, with the recessed portion (12) or the claw (13), a gap between the outer surface of the side wall (1*a*) of the first plate (1) and an inner surface of the tab part (9).

The present invention according to a fourth aspect thereof provides the header plateless heat exchanger according to any of the first to third aspect, wherein a protruding portion (14) is provided downward on the lower end surfaces (9*c*) of the tab part (9) to partially fill a gap between the tab part (9) and a member located below the first plate (1).

According to the present invention, the tab parts 9 provided so as to extend from the positions of the bulging portion 4 of the side walls la of the first plate 1 are folded back to the outer surfaces of the side walls 1*a* of the first plate 1; the seating portions 2*c* on the lower end surfaces of the side walls 2*a* of the second place 2 sit on the upper end surfaces 9*a* of the tab parts 9; and the lower end surfaces 9*c* of the tab parts 9 match the outer surface of the groove bottom 1*b* of the first plate 1. In other words, in place of the conventional stepped, portion 10 (see FIG. 13) having a round shape, the second plate 2 is caused to sit on the sitting surface, for which the upper end surfaces 9*a* of the tab pares 9 are used, and the first and second plates are brazed with each other in an integral manner.

Thus, the header tank 8 and the flat tube 5 are tightly contacted with each other without any gap at least at the joining portion, of the both plates 1 and 2, and the large gap formed between the header tank 8 and the A portion of the flat tube 5 can be filled, which makes it possible to improve air-tightness and liquid-tightness of the header tank 8 and the core 6.

In the configuration described above, in a case where the lower end portion of the tab part 9 in the height direction is cut-out according to the second aspect of the invention, the cut-out portion 11 makes the folding back easy and accurate.

In the configuration described above, in a case where the recessed portion 12 or a claw 13 is provided on the lower end edge of the tab part 9 in the thickness direction according to the third aspect of the invention, it is possible to fill the gap between the R portion of the first plate 1 and the tab part 9.

In the configuration described, above, in a case where the protruding portion 14 is provided downward, on the lower end surface of the tab part 9 according to the fourth aspect of the invention, it is possible to fill the gap between the tab part 9 and a member (the second plate 2 or lower portion of the inner periphery of the header tank 8) located below the first plate 1.

On the other hand, interference occurs between the tab part 9 of the first plate 1 and the member located therebelow, and pushes up the tab part 9, possibly causing misalignment of the joining portion of the second plate 2 and the first plate 1. To solve this problem, it is preferable that the protruding portion 14, which is provided on the tab part 9, is provided at a position farthest from the opening end of the bulging portion 4, and the corner portion 9*d* of the upper end surface 9*c* has a round shape, as illustrated in FIG. 11.

In this case, the length of contact between the tab part 9 of the first plate I and the second plate 2 reduces, and hence, the misalignment of the second plate 2 can be reduced even if interference occurs between the members.

DETAILED DESCRIPTION OF THE INVENTION (Basic Structure of Heat Exchanger)

This header plateless heat exchanger is used, for example, as EGR cooler or a condenser, in which, gas is introduced into a header tank 8 side; the introduced, gas passes within flat tubes 5; cooling water flows into an area surrounded by the outside of the flat tubes 5 and a casing 7; and heat exchange is performed between the gas and the cooling water.

Figure 4:
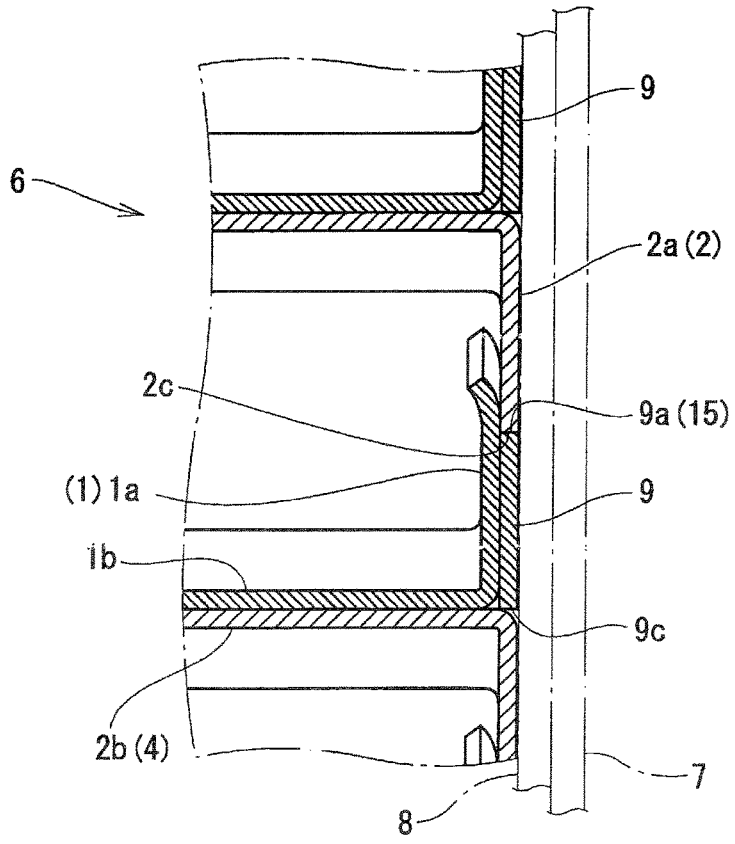
FIG. 4 is a traverse cross section of a core 6, taken at a position IV-IV in FIG. 3, including a stacked body of the same flat tubes 5.

This heat exchanger includes a core 6 formed by stacking, at bulging portions 4, flat tubes 5 having both ends bulging in the thickness direction, and does not require any header plate. In addition, a pair of header tanks 8 are fitted over both ends of the core 6 in the longitudinal direction as illustrated in FIG. 4. Moreover, in this example, the casing 7 is fitted over the outer periphery of the core 6 through an opening of the header tank 8. For example, the casing 7 includes a casing body formed into a C-shape in cross section, and an end lid that closes the opening thereof, and the entire casing 7 is formed into a cylindrical shape. The casing body has inlet and outlet, which form a pair, for cooling water, and a pair of pipes are connected thereto.

It should be noted that, in this example, the header tank 8 is fitted over both ends of the core 6, and the casing 7 is fitted over the outside of the header tank 8. However, instead of the configuration, the casing 7 may be fitted over the core 6, and the header tank 8 may be fitted over the outside of the casing 7. In the case also, the header tank 8 is disposed on both ends of the core 6, which is the configuration described above as the first aspect of the invention.

In addition, the casing and the header tank may be integrally formed. Even in the case, the header tank 8 is disposed on both ends of the core 6, which is the configuration described above as the first aspect of the invention.

Members used to manufacture the header plateless heat exchangers are obtained by press forming metal plates (aluminum, aluminum alloy, steel plates, and the like), with brazing materials covering or being applied to at least one side of the surface layer thereof. Respective parts are assembled together, and then, are integrally brazed in a furnace at high temperatures.

EXAMPLE 1

Hereinbelow, the embodiments of the present invention will be described with reference to the drawings.

FIGS. 1 to 4 illustrate Example 1 of the present invention.

A flat tube 5 used in the present invention includes a joined body of a first plate 1 and a second plate 2, which are a pair of upper and lower plates each formed into a groove shape; both end portions of each of the plates 1 and 2 in the longitudinal direction are expanded and opened in the thickness direction; and a bulging portion 4 is formed there.

Figure 1:
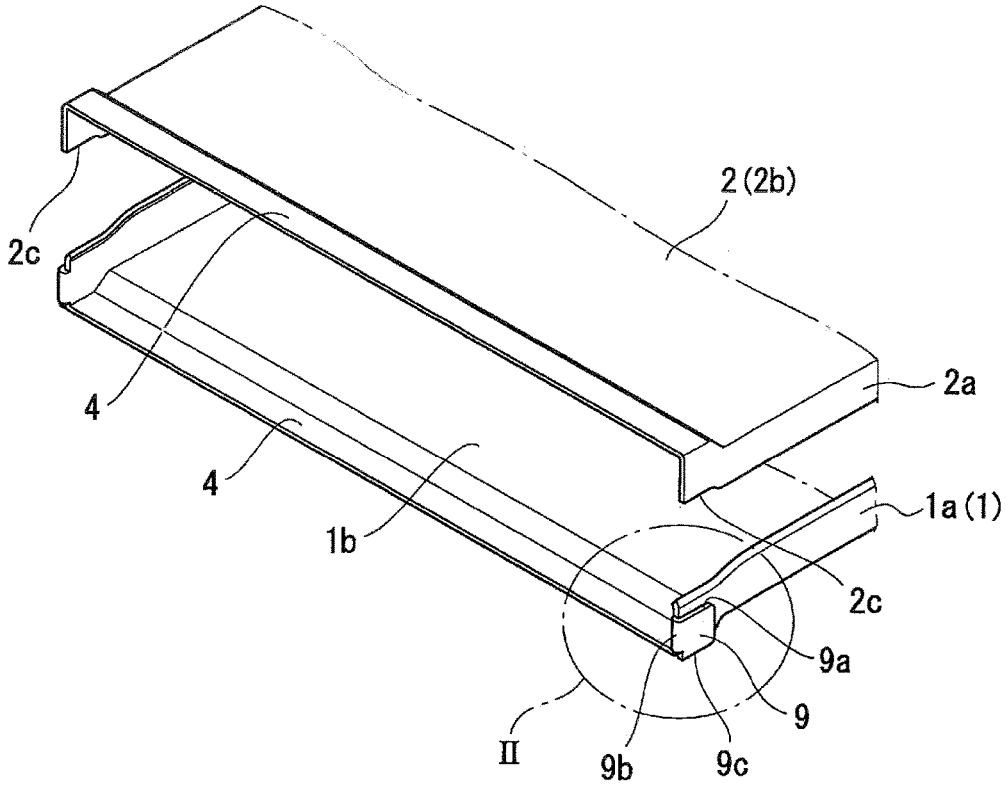
FIG. 1 is an exploded perspective view illustrating a main portion of a flat tube 5 of a header plateless heat exchanger of the present invention.
Figure 2:
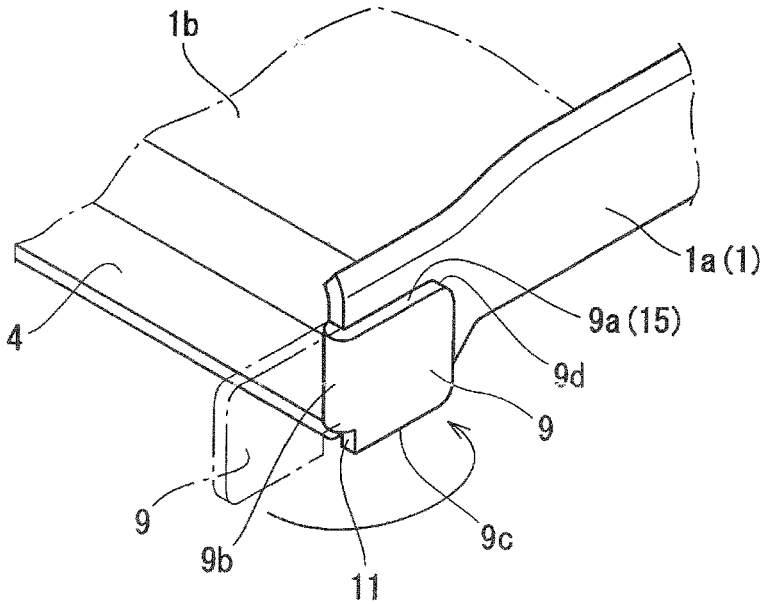
FIG. 2 is an enlarged view of a portion II in FIG. 1.
Figure 13:
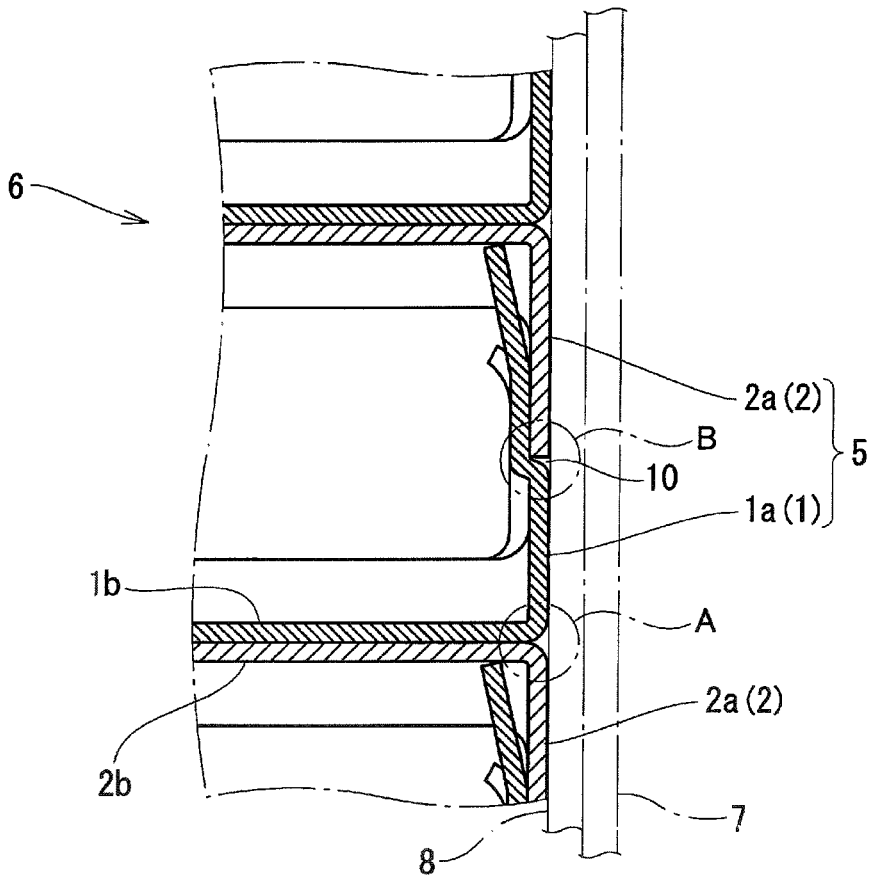
Fig. 13 PRIOR ART
FIG. 13 is a traverse sectional view illustrating main portions of a header plateless heat exchanger of a conventional example.

As illustrated in FIG. 1, the inner surfaces of side walls 2*a* of the second plate 2 are fitted over the outer surfaces of a pair of side walls la of the first plate 1. In addition, the tab parts 9 are integrally formed so as to extend through a folded portion 9*b*, on the side wall (1*a*) of each of the both end portions of the first plate 1 in the longitudinal direction. The tab part 9 is folded back outward, and is overlapped on the outer surface of the side wall la of the first plate 1, and the upper end surface 9*a* of the tab part 9 forms a sitting surface 15. The sitting surface 15 corresponds to the stepped portion 10 (see FIG. 13) of the conventional-type flat tube, and a seating portion 2*c* of the side wall 2*a* of the second plate 2 sits thereon. Furthermore, the lower end surface 9*c* of the tab part 9 is aligned to match the outer surface of the groove bottom 1*b* at the bulging portion 4 of the first plate 1 as illustrated in FIG. 4.

Figure 3:
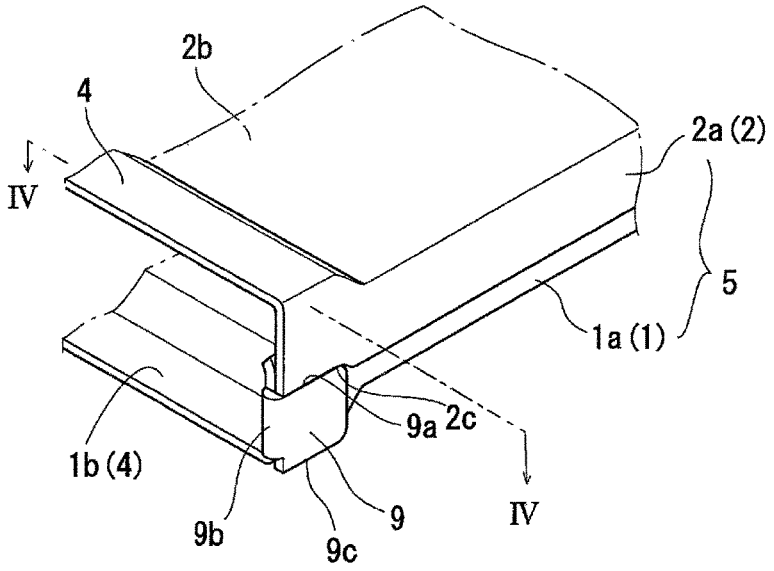
FIG. 3 is a perspective view illustrating a main portion of an assembly of the same flat tube 5.

In this example, a cut-out portion 11 is provided at the lower end portion of the folded portion 9*b*, facilitating folding back of the tab parts 9. In addition, as illustrated in FIGS. 1 and 3, by cutting out the seating portion 2*c* of the second plate 2 into a shape that matches the sitting surface 15 of the tab part 9, it is possible to easily position both of the plates 1 and 2.

The flat traces 5 configured as described above are stacked at the positions of the bulging portions 4 to form the core 6, and the opening of the header tank 8 is fitted over both end portions in the longitudinal direction, whereby giving a state illustrated in FIG. 4.

As illustrated in FIG. 4, the tab part 9 has the upper end surface 9*a* and the lower end surface 9*c* both formed into a right angle, and hence, it is possible to achieve tight contact with the inner peripheral surface of the header tank 8 over the entire length of the tab part 9 in the height direction without any gap. In addition, the outer surface of the side wall 2*a* of the second plate 2, with which the upper end surface 9*a* is joined together, also tightly contacts with the inner peripheral surface of the header tank 8 over substantially the entire length, except for the corner portion with the groove bottom 2*b*. Thus, it is possible to reduce a portion suffered from the loss of brazing as much as possible at the time of brazing each part, and hence, it is possible to improve air-tightness and liquid-tightness around the header tank 8 of the heat exchanger.

EXAMPLE 2

Figure 5:
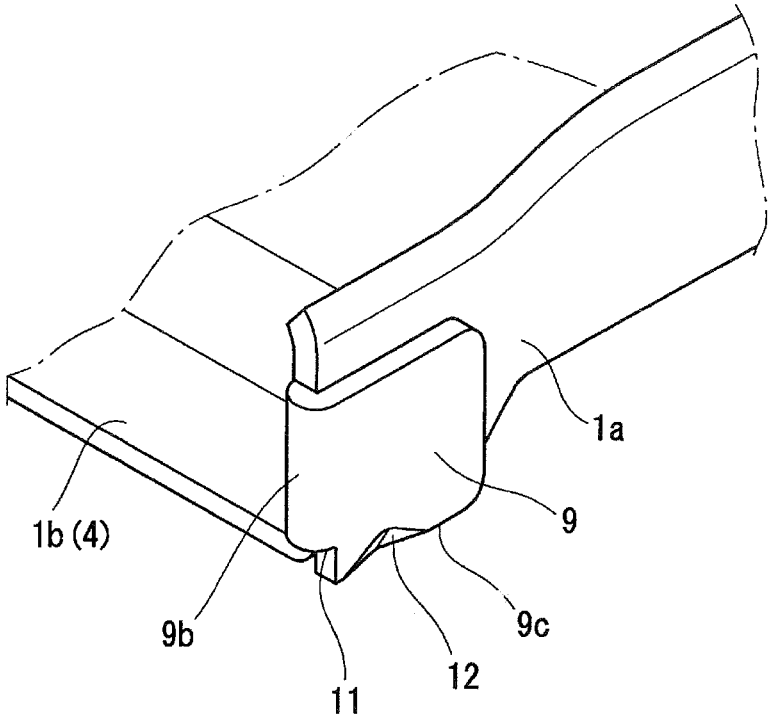
FIG. 5 is a perspective view illustrating a main portion of a first plate 1 used in Example 2 of the present invention.
Figure 6:
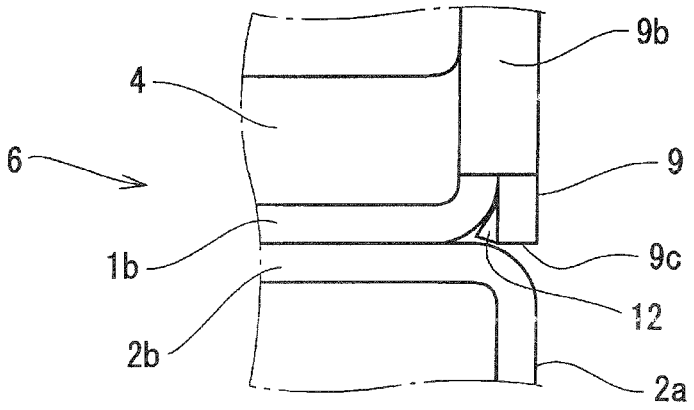
FIG. 6 is a side view illustrating a main portion of the same flat tube 5.

FIGS. 5 and 6 illustrate Example 2 of the present invention.

This example differs from Example 1 in that a recessed portion 12 is provided at the lower end portion of the tab part 9 in a direction of the side wall 1*a* of the first plate 1. This recessed portion 12 is provided, by striking, at a part of the lower end portion of the tab part 9 (in the vicinity of the opening of the flat tube 5 in this example) in the thickness direction, as illustrated in FIG. 5.

With this configuration, the gap between the R portion of the first plate 1 and the tab part 9 can be partially filled as illustrated in FIG. 6, so that the loss of brazing can be further prevented as much as possible.

EXAMPLE 3

Figure 7:
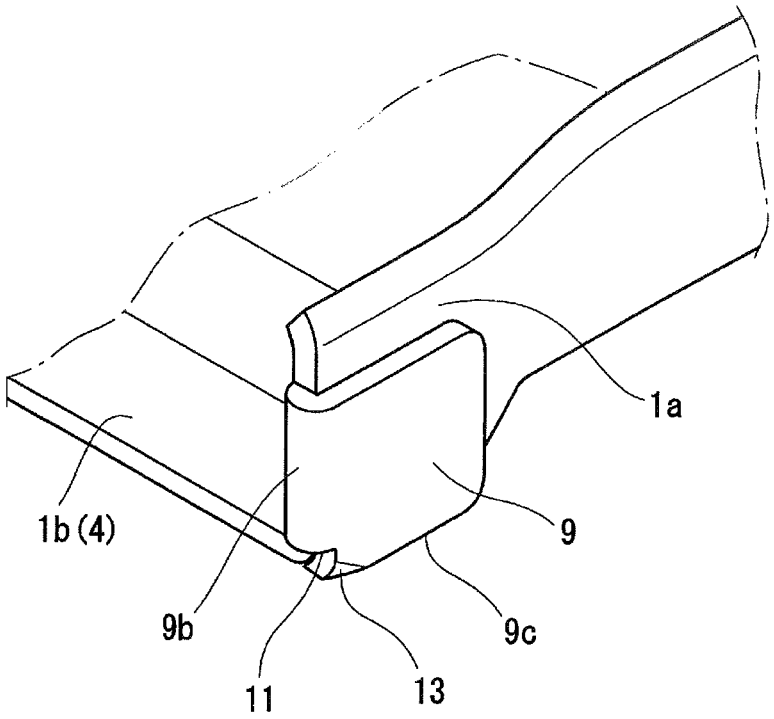
FIG. 7 is a perspective view illustrating a main portion of a first plate 1 used in Example 3 of the present invention.

FIG. 7 illustrates Example 3 of the present invention.

This example differs from Example 2 in that a claw 13 folded into a plane triangle is provided in place of the recessed portion 12 of the tab part 9. In this example also, it is possible to obtain an effect similar to that of Example 2.

In Example 2 and Example 3, the outer surface of the tab part 9 is brought into close contact with the inner peripheral surface of the header tank 8 except for the portion where the recessed portion 12 or claw 13 is formed, and hence, there is no possibility that air-tightness or liquid-tightness deteriorates.

EXAMPLE 4

Figure 8:
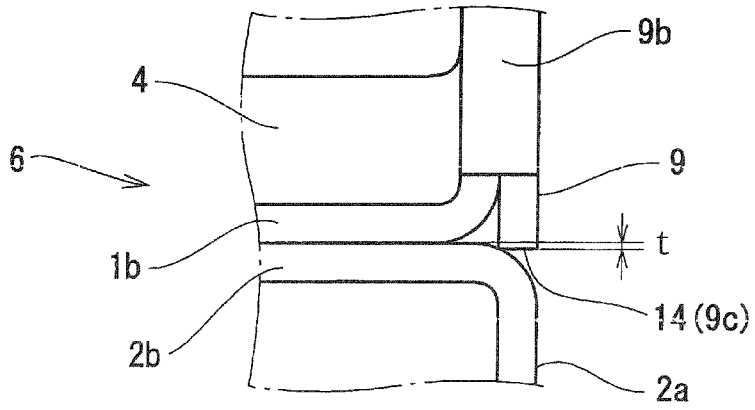
FIG. 8 is a side view illustrating a main portion of a flat tube 5 used in a fourth Example 4 of the present invention.
Figure 9:
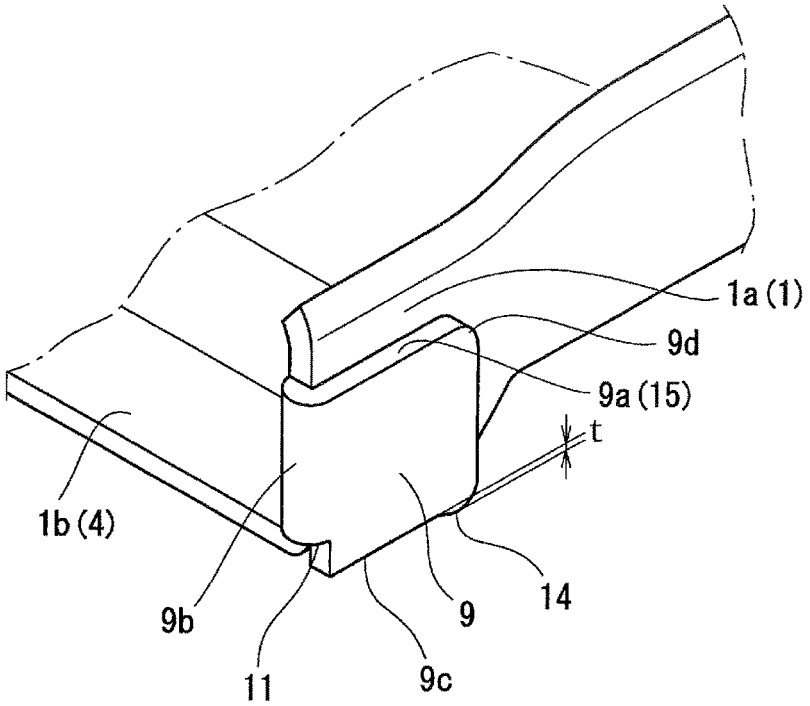
FIG. 9 is a perspective view illustrating a main portion of a first plate 1 used in the same example.

FIGS. 8 and 9 illustrate Example 4 of the present invention.

This example differs from Example 2 or Example 3 described above in that a protruding portion 14 that is provided so as to protrude downward is provided on the lower end surface 9*c* of the tab part 9. FIG. 8 is an explanatory view illustrating a case where the core 6 is formed with the flat tubes 5.

It is possible to partially fill a gap+between the tab part 9 and a member (the second plate 2 of the flat tube 5 or the lower portion of the inner periphery of the header tank 8) located below the first plate 1, in particular, a gap having a triangle shape formed by the header tank 8, the corner portion of the second plate 2, and the tab part 9 of the first plate 1.

Figure 12:
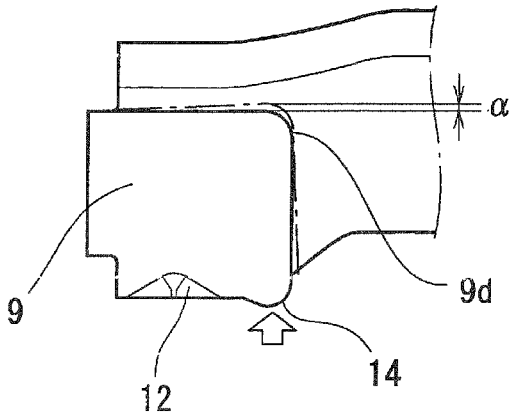
FIG. 12 is a diagram illustrating operation in the same example, and is an explanatory view illustrating a case where the round of the corner of the tab part 9 is small.

However, in the case of this shape, interference occurs between the corner portion of the second plate 2 and the protruding portion 14 of the tab part 9, and pushes up, by an amount of α, the corner portion 9*d* of the tab part 9 with the folded portion 9*b* being the fulcrum as illustrated in FIG. 12, possibly causing misalignment of the joining portion with the second plate 2.

Figure 11:
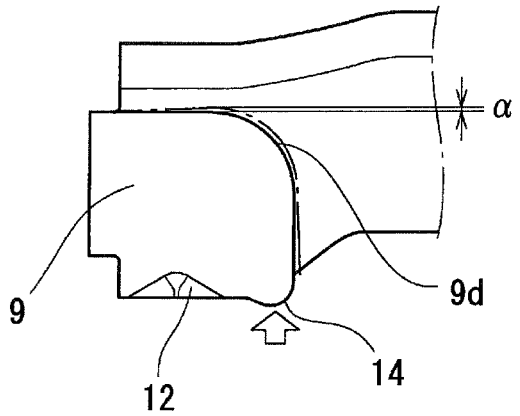
FIG. 11 is a diagram illustrating an operation in the same example, and is an explanatory view illustrating a case where the round of the corner of tab part 9 is large.

To solve this problem, the protruding portion 14, which is provided on the tab part 9, is provided at a position farthest from the opening end of the bulging portion 4, and the corner portion 9*d*, which faces the position, is provided to have a large round shape as illustrated in FIG. 11, whereby the amount of push-up is reduced.

EXAMPLE 5

Figure 10:
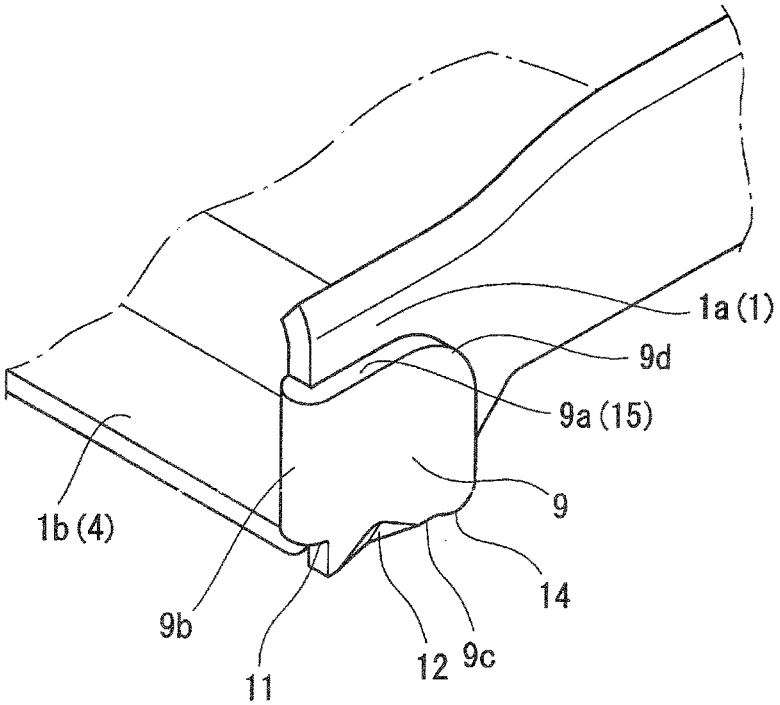
FIG. 10 is a perspective view illustrating a main portion of a first plate 1 used in Example 5 of the present invention.

FIGS. 10 to 12 illustrate Example 5 of the present invention, in which the recessed portion 12 is added to the example of FIG. 9 to fill the triangle gap inside the tab part 9 of FIG. 8.

The invention claimed is:

1. A header plateless heat exchanger, comprising a first plate and a second plate each bent and formed into a groove shape by press forming, the plates respectively including side walls each having a height on each longitudinal end of the plate higher than a height at a midpoint portion of the plate, the first plate and the second plate being joined with each other at the side walls to form a flat tube having a bulging portion in a height direction on longitudinal end of the flat tube, a plurality of the flat tubes stacked at the bulging portion to form a core, and a casing fitted over an outer periphery of the core and a header tank and disposed at both ends of the core, wherein tab parts located at the bulging portion and disposed so as to extend from the side walls of the first plate are folded back to lie over outer surfaces of the side walls of the first plate, and lower end surfaces of the side walls of the second plate are seated on upper end surfaces of the tab parts, and lower end surfaces of the tab parts conform to an outer surface of a groove bottom of the first plate.

2. The header plateless heat exchanger according to claim 1, wherein a lower end portion of the tab part in a height direction is cut out at a folding-back position to form a cut-out portion at the position, thus facilitating folding back at the end portion.

3. The header plateless heat exchanger according to claim 1, wherein a recessed portion or a claw is provided by striking in a thickness direction, located on the lower edge of the tab part to partially fill, with the recessed portion or the claw, a gap between the outer surface of the side wall of the first plate and an inner surface of the tab part.

4. The header plateless heat exchanger according to claim 1, wherein a protruding portion is provided downward on the lower end surfaces of the tab part to partially fill a gap between the tab part and a member located below the first plate.

* * * * *